United States Patent [19]

Choate et al.

[11] 4,021,972

[45] May 10, 1977

[54] AIR SUPPORTED, MULTI-WALL, INSULATED STRUCTURE AND PROCESS OF PRODUCING SAME

[76] Inventors: James Edwin Choate, 260 Pine Valley Road, Marietta, Ga. 30060; John Robson Hall, 4041 Randall Mill Road, Atlanta, Ga. 30327

[22] Filed: July 9, 1975

[21] Appl. No.: 594,597

[52] U.S. Cl. ..... 52/2; 52/404; 52/743

[51] Int. Cl.[2] ..... E04B 1/34

[58] Field of Search ..... 52/2, 404, 406, 743, 52/65, 309

[56] References Cited

UNITED STATES PATENTS

| | | | |
|---|---|---|---|
| 2,235,542 | 3/1941 | Wenzel | 52/743 X |
| 2,989,790 | 6/1961 | Brown | 52/743 |
| 3,358,059 | 12/1967 | Snyder | 52/743 X |
| 3,538,957 | 11/1970 | Rheaume | 52/2 |
| 3,742,657 | 7/1973 | Price | 52/2 |

*Primary Examiner*—Price C. Faw, Jr.
*Assistant Examiner*—Carl D. Friedman
*Attorney, Agent, or Firm*—Newton, Hopkins & Ormsby

[57] ABSTRACT

An air supported multi-wall insulated structure formed of a flexible impermeable, impervious or imperforate wall and a permeable, pervious or perforate wall defining juxtaposed cavities or compartments between the walls, filled with insulating material such as particulate expanded polystyrene material and the process of inflating the envelope and then filling the compartments with the insulating material by blowing the same into place. In certain embodiments, the perforate wall forms the inner wall. In another embodiment it forms the outer wall. In still another embodiment the impermeable wall is the central wall and perforate walls are on both sides of the impermeable wall. In still another embodiment the central and outer walls are impermeable, forming the air space and the inner wall is perforate and contains the insulating material.

27 Claims, 10 Drawing Figures

AIR SUPPORTED, MULTI-WALL, INSULATED STRUCTURE AND PROCESS OF PRODUCING SAME

BACKGROUND OF THE INVENTION

1. Field of the Invention

This invention relates to air supported structures and is more particularly concerned with an air supported, multi-wall, insulated structure wherein the inside temperature is maintained at a temperature different from that of outside air.

2. Description of the Prior Art

Air supported structures having a single sheet of polyethylene, polypropylene, nylon, polyester, glass fabric and similar materials are well known. They are frequently reinforced by webbing, cables or rope. The sheet is anchored around its skirt so that an air pressure differential can be maintained between the inside and the outside. A blower is mounted to discharge air under pressure into the envelope thus formed. Sometimes the blower is continuously operated, with an equal amount of air leaking out of the envelope, once inflation is complete. Other blowers operate intermittently. In any event, a small air pressure differential is sufficient to hold up the envelope in an inflated condition because of its light weight.

Double wall air supported structures having two sheets with a dead air space or cavity therebetween to provide insulation, are known. Their insulating properties are not good.

In the patent to Suits, U.S. Pat. No. 2,649,101, the cavity is filled with an insulating material and the air therein is evacuated, causing the sheets to collapse against the insulation, for providing rigid structure. Other patents, such as the patent to Lee, U.S. Pat. No. 3,304,665, Furrer et al. U.S. Pat. No. 3,357,142 and Ming-Yang Chang, U.S. Pat. No. 3,257,481 describe enclosures, each of which is a rigid insulating structure formed by injecting foaming plastic or similar material into the space between the two sheets. These too form rigid structures.

None of these double-walled structures described above, maintain the flexibility of the outer wall, or sheet, as in single walled structures and in none can the insulating material be easily removed for folding the envelope into a compact, portable form for reinflation at a second site. Furthermore, none has provided adequate insulation at sufficiently low weight for the temperature differential desired between inside and outside.

In the past, to the best of our knowledge, air supported structures have usually not been used for refrigerated structures in humid climates, nor have they found general use in extremely cold climates. The reason for this is probably because, sheets of ice will collect on the warm humid side of a wall when the other side of the wall is at a temperature, below freezing, thereby weighing the structure down or breaking off and falling when wind flexed the structure.

The structure of the present invention obviates the problem of the ice sheets and also the problem of providing a readily transportable, inexpensive structure which can be quickly erected and insulated.

In the past, indoor ski slopes, using artificially manufactured snow, have not, to our knowledge, been produced, even though U.S. Pat. No. 3,250,530 does disclose such a structure. The reason is probably due to the high cost of such a large structure with no central supports. The present invention provides a low cost structure which is suitable for the unobstructed spanning of the ski slope area and for maintaining the refrigerated conditions which are necessary in such a building.

SUMMARY OF THE INVENTION

Briefly described, the structure of the present invention includes a closed envelope formed from a flexible, generally air and moisture retaining, impervious, wall, skin, sheet or web preferably of plastic. This main or primary sheet is contoured to form a dome, namely an inverted concaved member anchored to an appropriate footing or foundation and provided with an air impeller, blower or compressor, taking a suction from the exterior and discharging into the interior of the envelope to maintain the envelope, inflated.

In one form of the invention refrigeration units maintain the air in the interior at below freezing temperatures and artificial snow or ice is disposed on the interior ground surface, in the event the structure houses a ski slope or ice skating rink.

According to the present invention, a pervious flexible, secondary wall, skin, sheet or web, which is preferably in the form of an open mesh plastic net, is secured to the inside portion of the main sheet by means of flexible ribs. Thus, with the main sheet, this secondary sheet defines a plurality of juxtaposed, insulation containing, compartments or cavities which are filled with the pop-corn like, form retaining, light weight, expanded plastic particles or aggregates of insulation.

In a certain embodiment, the compartments are vertically disposed, being separated by the parallel plastic ribs. In such an arrangement, the secondary wall or sheet is overlapped adjacent an upper portion of the structure so that a nozzle of an air gun can be inserted therebetween to discharge, in situ, the air impelled particles into the various cavities, successively. In another embodiment these particles are discharged from the outside ground level, up through built-in, flexible plastic tubes leading to the upper area of the cavity, the tubes being prefabricated with and secured along the inner surface of the secondary wall. In either event quite large and well insulated structures are provided.

Other embodiments of the invention include insulation on the exterior or on both sides of the impervious sheet, each having a secondary wall for retaining the particles in place. Still other embodiments include more than one impervious sheet or wall either retaining the insulation particles or defining an air space as one strata adjacent to the retained particles.

Accordingly, it is a primary object of this invention to provide an inflatable enclosure having improved insulating quantities and resistance to condensation caused by a differential in temperature between inside and outside.

Another object of the invention is to provide an enclosure, which is flexible, lightweight and inflatable, the enclosure being capable of ready assembly on the site with the insulation being quickly and simply installed, in situ, after inflation of the enclosure.

Another object of the present invention is to provide a process of fabricating and erecting in a simple, quick fashion, an insulated, flexible, inflated enclosure from a portable sheet structure and bulk stored insulating material.

Other objects, features and advantages of the present invention will become apparent from the following description when taken in conjunction with the accompanying drawings wherein like character of reference designate corresponding parts throughout the several views.

BRIEF DESCRIPTION OF THE FIGURES OF DRAWING

DESCRIPTION OF PREFERRED EMBODIMENT

Referring now in detail to the embodiments chosen for the purpose of illustrating the present invention, in FIGS. 1, 2, 3 and 5 a typical inflated air supported structure 10, constructed in accordance with the present invention, is shown. This air supported structure 10 includes a load bearing main or primary outer wall 11. This outer wall 11 is a flexible envelope formed of impervious, plastic skin, web or sheet material, such as polyethylene or polypropylene. Since a very large structure 10 is produced, the primary wall 11 is formed of a plurality of rectangular side sheets 12 disposed in side-by-side relationship and provided with overlapping edges which are secured together along transversely equally spaced parallel seams 13. The seams 13 are formed by glue, adhesive, welding or the like.

Figure 1:
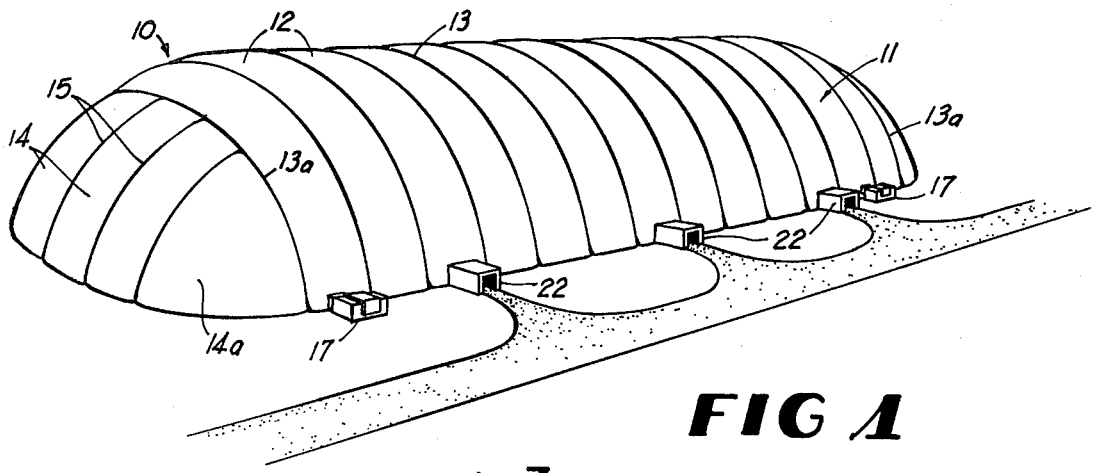
FIG. 1 is a perspective view of a large enclosure constructed in accordance with the present invention.

As shown in FIG. 1, the sheets 12, when the structure 10 is inflated, are disposed in juxtaposition extending transversely in arcuate fashion from one side to the other, being supported solely by the pressure of the air within the structure 10 greater than the pressure of the ambient air. The ends of the structure 10 are rounded, being formed of longitudinally arcuately extending end sheets 14 which are secured to the outer edges 13*a* of the outermost sheets 12, these sheets 14 being joined together along their overlapped edges by longitudinal seams 15. Concaved triangularly shaped corner sheets 14*a* form the rounded corners of the structure 10, as shown in FIG. 1.

Figure 2:
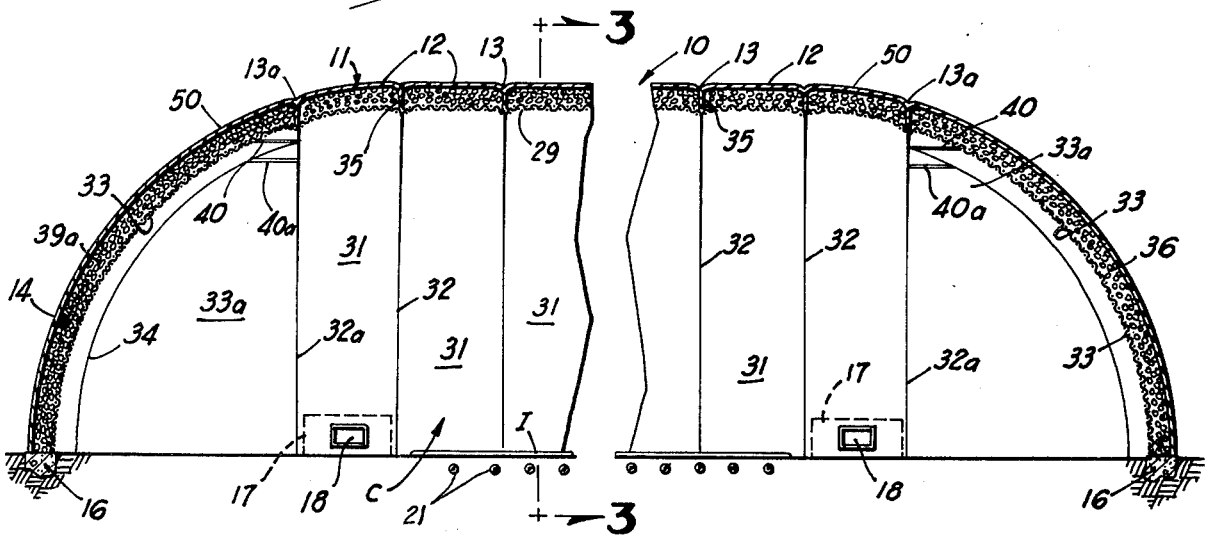
FIG. 2 is a vertical sectional view of the enclosure depicted in FIG. 1.
Figure 3:
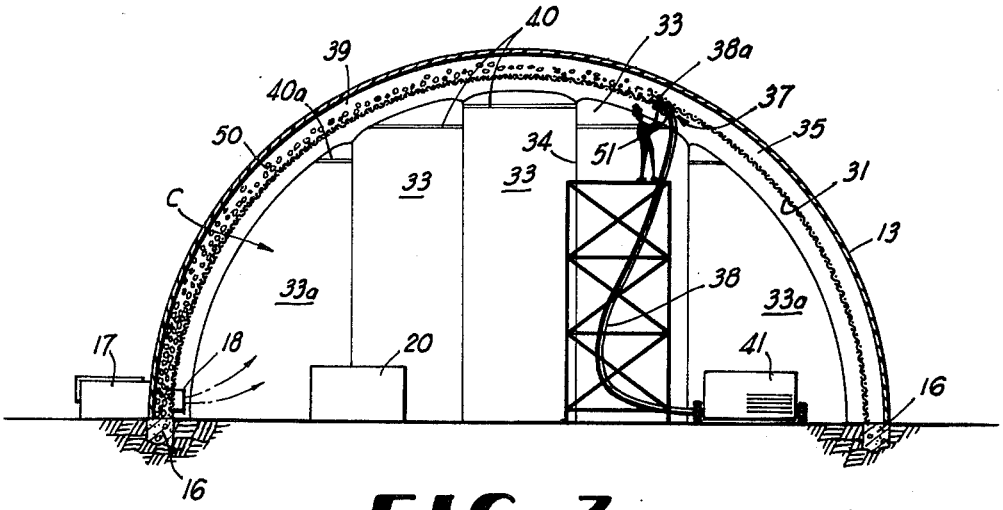
FIG. 3 is a vertical sectional view taken substantially along line 3—3 in FIG. 2 and depicting the enclosure as being filled according to a first process embodiment of the present invention.

Thus a dome shaped envelope is provided, lower edges of which are received by and anchored to concrete footing 16 in a conventional fashion. The footing 16 is preferably imbedded in the ground, as depicted in FIGS. 2 and 3.

In the embodiment shown in FIGS. 1, 2, 3 and 5, the air pressure within the interior of the structure 10 is maintained by a plurality of blowers, fans or air impellers 17 which discharge air from the outside through ducts 18 which penetrate the sheets 12, adjacent the footing 16. Conventional automatic controls (not shown) regulate when the blowers 17 are placed in operation.

A heat exchange means such as refrigeration unit 20 or a plurality of such refrigeration units are provided for cooling (or heating, as the case may be) the air in the interior C of the structure 10. This refrigeration unit 20 is of conventional construction and, in the event that an ice skating rink or a ski slope is to be housed within the structure 10, the heat exchanger means should include a plurality of pipes 21 imbedded in the ground below the structure 10 so as to circulate the refrigerant or heat exchange fluid from the exterior into the interior C and maintain the interior C at a prescribed temperature range. Such heat exchange pipes 21 may also be utilized for heating purposes, in the event that the space is to be heated rather than cooled. Since the heating and air conditioning of structures is well known, no detailed description of the equipment is necessary.

Artificial snow or water which forms ice I is disposed on the ground over the pipes 21.

In the embodiment depicted in FIG. 1, three air lock door assemblies 22 are shown. These assemblies 22 penetrate structure 10 at ground level, forming air seals permitting persons to enter the structure 10 or depart therefrom, without releasing an appreciable amount of air.

According to the present invention, there is provided a secondary flexible perforate, porous, pervious or permeable wall 30, inwardly adjacent to the main or primary wall impermeable, impervious or imperforate 11. The purpose of this wall 30 is to define with main wall 11 an insulation receiving area, cavity or space. In more detail, the secondary or perforate wall 30 is preferably formed of open mesh, flexible, plastic sheet, web, or skin material, such as nylon netting having pores or opening 29 through which air and moisture may readily pass. The contour of secondary wall 30 conforms generally to the contour of the flexible main wall 11. The wall 30 is preferably formed in a manner similar to the forming of the outer wall 11, in that side area of wall 30 includes a plurality of juxtaposed, flexible, perforate rectangular, sheets, webs or skins 31, transversely disposed with their adjacent edges overlapping and adhered, glued, stitched, welded or otherwise joined together along seams 32. Each of the sheets 31 is approximately the same shape and size as its associated sheet 12 so that the parallel transverse seams 32, formed at the junction of the common edges of adjacent sheets 31, are disposed inwardly adjacent to and in transverse alignment with the seams 13 of wall 11.

The ends of wall 30 are formed by juxtaposed, flexible, rectangular, end sheets, webs or skins 33 corresponding in shape and contour to and end sheets 14 and the triangular corner sheets 33*a* corresponding to corner sheets 14*a*. The overlapped edges of sheets 33, 33*a* form longitudinal seams 34 while the inner and upper edges of sheets 33, 33*a* are joined by seams 32*a* to the outer edges of the outer sheets 31.

For forming vertically disposed, insulation receiving compartments, a plurality of arcuate, transversely parallel, longitudinally evenly spaced, ribs 35 are provided, joining the inner wall 30 to the outer wall 11. These ribs 35 can be integrally formed by the edge portions of sheets 31 or the edge portions of sheets 12. Preferably, the ribs 35 are formed of the plastic netting from which the wall 30 is produced. Such netting can usually assume the arcuate shape of the rib 35 without concentrating stresses in the material.

It is thus seen that each pair of opposed sheets 12 and 31, together with the adjacent ribs 35, form tubular arcuate side compartments 39 extending, when the structure 10 is inflated, in an arch from the foundation 6 on one side to the foundation 16 on the transversely opposed side.

Arcuate longitudinally disposed end ribs 36 extend between the outer seams 15 and inner seams 34 to support the sheets 33 and 33*a* from sheets 14, 14*a* and provide arcuate longitudinally disposed pockets or compartments 39*a* which extend up from footing 16 and terminate at the end most ribs 35.

As best seen in FIGS. 2 and 3, each sheet 31 is provided, at its uppermost portion, with a transverse closeable slot, aperture, port or opening 37 formed by a pair of overlapping straight edges of sheet 31, the overlapping portions normally lying flat against each other to close the filling slot 37. However, these portions are deformable away from each other by the nozzle 38*a* (seen in FIG. 3) of a filling hose or flexible tubular conduit 38. Also, the sheets 33 and 33*a* are provided with similar individual, normally closed filling slots 40 and 40*a*, respectively, formed by overlapping portions of the sheet.

When the structure 10 has been inflated by the air impellers 17, a portable blower-conveyor 41 (in FIG. 3) is brought, through an air lock 22, into the interior or cavity C. Also, scaffolding 42 is brought in and erected, as shown in FIG. 3. The hose or conduit 38 is then connected to the discharge of the blower-conveyor 41 and the hopper of the blower conveyor 41 is filled with the pop-corn like insulation aggregate or particles or insulating fill material 50.

As depicted in FIG. 3, the operator 51 inserts the nozzle 38*a* through the slot 37 so that the nozzle 38*a* will discharge into the compartment 39 between the two sheets 13 and 31. Preferably, the slot 37 is arranged adjacent the top of structure 10 so that it is disposed on one side of the apex or zenith of the arch of the sheets 13 and 31, and the slot 37 opens toward this apex.

When the nozzle 38*a* is appropriately installed in slot 37, and the blower-conveyor 41 turned on, compressed air directs the aggregates toward the apex so that they fall or cascade down the far side of the compartment 39 and progressively build-up so as to fill-up the space between sheets 13 and 31 and the adjacent ribs 35.

When one side of the compartment 39 is filled, the aggregate 50 bounce off of the fill and begin to fill up the near side of the compartment 39 until they are packed in.

In like fashion the other compartments 39 and 39*a* are filled through slots 37, 40, and 40*a*. When each compartment is filled, the nozzle 38 is withdrawn whereby the slots 37, 40 and 40*a* automatically closes. The slots 40, 40*a* open upwardly so that the nozzle 38 directs the aggregates in an upward direction whence they fall by gravity to fill up the associated compartment 39*a*. Thus, when the operation is completed, the aggregates 50 essentially cover the inside surface of the outer or main impervious wall 11, being retained in place by the netting or porous wall 30.

Figure 4:
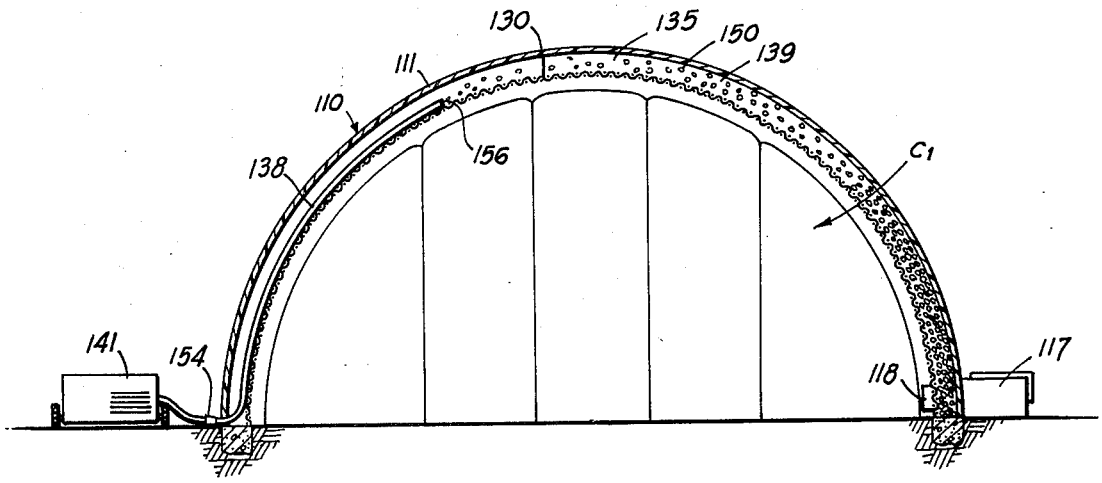
FIG. 4 is the same sectional view as FIG. 3 with the enclosure being filled according to second process embodiment of the invention.

In FIG. 4 a second embodiment of the present invention is depicted wherein the compartments 139 are filled with insulation aggregate 150 from the exterior, rather than from the interior, as previously shown. Thus, in FIG. 4 a structure 110, which is substantially identical to the structure 10, is shown, the structure 110 having an outer or main flexible impervious wall 111 forming the closure and a flexible pervious or perforate inner or secondary wall 130 disposed inwardly adjacent wall 111, the two being retained together by ribs, such as ribs 135, to form juxtaposed compartments 139 in the same manner as the compartments 39 of the preceeding embodiment. The structure 110 is inflated and retained in an inflated condition by a blower 117 which feeds air through duct 118 into the interior C of the structure 110. It will be observed, however, that the inside wall 130 requires no slots or closeable ports, such as slots 37 since filling does not take place from the inside.

According to the embodiment of FIG. 4, an upstanding flexible, plastic, hollow tube, such as tube 138, is secured within each compartment 139. The tube 138 is preferably formed from polyethylene or polypropylene and is tacked, adhered, glued, stitched, welded or otherwise affixed to, the outer wall 111, or the inner wall 130, or one of the ribs 135. Preferably, the tube 138 is adhered along an axial line of the tube to the inner wall 130.

The intake end portion of tube 138 protrudes through the main wall 111 adjacent the ground and is provided with a valve 154, outwardly of the main wall 111. The discharge end 156 of the tube 138 terminates below and to one side of the apex or topmost portion of the compartment 139, being pointed toward the topmost portion.

When the tube 138 is to be used to fill its associated compartment, the discharge of portable blower conveyor 141 is connected to the valve 154 and is loaded with the liquid expanded polystyrene pop-corn like aggregates 150. When actuated, the conveyor 141 blows the aggregates 150 up through the tube 138, the aggregates 150 being propelled by compressed air from the portable blower-conveyor 141 at a velocity sufficient for the aggregates 50 to cross over the top portion and fall on the far side of the compartment 139.

Continued operation of conveyor 141 soon fills the compartment 139 on both sides and the aggregates 150 eventually clog the tube 138, itself. Then the valve 154 is closed and the portable blower conveyor 141 is moved to the next tube for the next compartment.

The valve 154 may simply constitute a portion of the flexible tube 139 which is folded against itself. It may also constitute a superficially sealed transverse section of tube 139 which is ruptured and then resealed.

Figure 5:
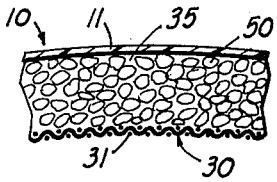
FIG. 5 is an enlarged, fragmentary, vertical, sectional view of a portion of the enclosure depicted in FIG. 1.

FIG. 5 illustrated the wall of the structure 10 in the first embodiment of the invention. The outer wall 11 is sufficiently impermeable to air to support the envelope when the air pressure inside of it is greater than the outside pressure. This difference in pressure is created on inflation and maintained by at least one blower 17. The inner wall 30 is sufficiently perforate or permeable to water vapor to allow passage of moisture out of the compartments 39, 39*a* when the vapor pressure is lowered in the interior C, as will happen when the refrigerating unit 20 is in operation and condenses the moisture at the machine. Thus, the refrigerating unit also functions as a dehumidifier for air in the interior C to maintain the dew point below the air temperature.

While it is recognized that permeability is a relative concept, it should be understood that the outer wall 11 is sufficiently impermeable to air that it does not allow air to escape rapidly with the small increase in pressure of about 1 inch to about 1½ inches of water, which is necessary to inflate and sustain the structure. Inner wall 30 need only be sufficiently permeable to allow water vapor to pass through it, as the interior C is gradually cooled after inflation and whenever other similar temperature or moisture changes occur.

In the preferred embodiment the outer wall 11 should be reinforced polyethylene while the inner sheet 30 is preferably a nylon net web having about 20 threads or strands per inch in both directions.

The transverse and end ribs 35 and 36 can be made of any light-weight material and can conveniently be cut or folded from the material used to make the outer wall 11 or the inner wall 31. The ribs 35, 36 are attached to at least one sheet during manufacture. If, as is shown in FIG. 3, a sheet 12 is folded to form the rib, and stitched or heat sealed at the top of the rib, only the associated sheet 31 need be attached, also by stitching or preferably heat sealing.

Particles or aggregates 50 are preferably liquid expanded polystyrene sufficiently loosely packed in each compartment that a substantial air space remains between adjacent aggregate 50. To be retained in the compartment 39 or 39*a* the fill or aggregate 50 must, of course, be of larger particle diameter than any holes, pores or openings in inner wall 30. It has been found that an aggregate type fill 50 is particularly suited for this structure and that expanded polystyrene is most suitable with, for example, cork being an alternative. Expanded polystyrene provides a relative non-compressible particle; and should have an aggregate diameter of about one-fourth to one-half inch. The fill or aggregate 50 as a whole is flexible enough to conform to changes in shape of the structure 10 in response to differing air pressures and also in response to wind. Cork and expanded polystyrene are both light-weight with cork somewhat less desirable because of its compressibility.

The process of erecting the enclosure is also materially aided where expanded polystyrene is used. Usually the envelope 10 is constructed from the two walls 11 and 30 and the ribs 35 and 36 by techniques as described above, with provision made to insert air locks 22 and inlet tube or ducts 18. The envelope 10 is anchored by the usual anchor skirt to footing 16. Then the blowers 17 are attached to inlet duct 18 and envelope 10 is inflated. The refrigerating unit 20, may then be turned on to begin cooling the interior or interior space C. It would also be possible to couple refrigerating unit 20 with a blower 17 to cool air before or while it is blown through inlet tube 18. This cooling step can occur simultaneously with the filling step described above.

Figure 6:
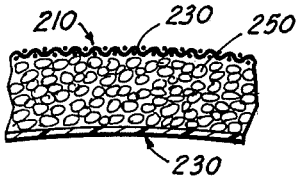
FIG. 6 is an enlarged sectional view similar to FIG. 5 and showing a second embodiment of the enclosure.

An alternative embodiment with a second structure 210 is illustrated in FIG. 6 with the outside wall 230 being permeable and the inside wall 110 being sufficiently impermeable to support the envelope by the air pressure differential. In this embodiment, drying and cooling of outside air will also dry the air in the compartment loosely filled with aggregate or fill 250.

Figure 7:
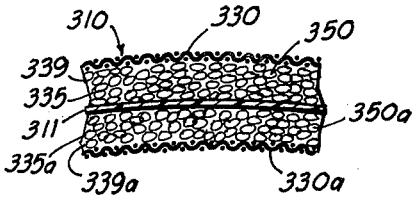
FIG. 7 is an enlarged sectional view similar to FIG. 5 and showing a third embodiment of the enclosure.

Three-walled structures are also possible. In FIG. 7, permeable outside and inside walls 330 and 330*a* are provided. A median main flexible impervious central wall 311 supports the envelope or structure 10. Ribs 335, 335*a* support both walls 330, 330*a* from wall 310 and aggregates 350 are disposed in both compartments 339, 339*a* thus formed.

Figure 8:
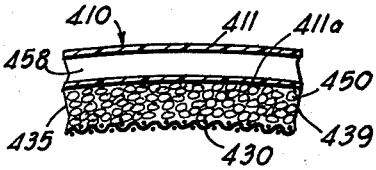
FIG. 8 is an enlarged sectional view similar to FIG. 5 and showing a fourth embodiment of the enclosure.

The embodiment illustrated in FIG. 8 has two impermeable walls, outer wall 411 and intermediate wall 411*a*, with an air space 458, therebetween. The inside wall 430 is permeable, defining, with intermediate or middle wall 30*a*, a compartment 439 filled with fill 450, providing the advantages of the first embodiment illustrated in FIG. 5.

Figure 9:
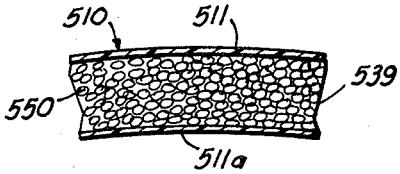
FIG. 9 is an enlarged sectional view similar to FIG. 5 and showing a fifth embodiment of the enclosure.

The embodiment illustrated in FIG. 9 has two impermeable walls 511 and 511*a* defining compartments 539 with fill 550, therein. Such an embodiment is not recommended since it tends to trap moisture. However, it may serve the purposes of the invention as long as care is taken to assure that the dew point of air in compartment remains below its temperature. Provision could be made in the fan inlet tube - refrigerating unit combination of this embodiment, otherwise similar to the units of the first embodiment, to assure that each compartment is suitably kept dry by allowing some cold air to escape from the inlet tube into the cavity or compartment 539. Such provision would substitute for the permeable wall shown in the first embodiment. However, the pressure inside the compartment 539 would necessarily be as high or higher than the pressure in interior space or cavity C to prevent the envelope 510 from collapsing around fill 550 and losing the insulating properties of the air in the compartment 539.

The insulating material in the present invention can be transported to the site as expandable beads (in a non-expanded condition) and then expanded, by use of heat, into the non-connected expanded aggregates, such as aggregates 50, using conventional equipment. These aggregates 50 have a density of from about 0.5 pounds per cubic foot to about 2 pounds per cubic foot. Thus, they are quite easily transported by the flowing air of the conveyors 41.

When fed into the cavities or compartments such as compartment 39 formed between the inner and outer walls, such as walls 11 and 30, the aggregates 50 abut each other but still provide interconnected air spaces between the abutting aggregates 50. Thus, there can be an interchange of air between the interior C of envelope or structure 10 and the air, dispersed in aggregates 50 between the walls 11 and 30. Thus, an equilibrium of the dew point is maintained while the air within the walls 11 and 30 is sufficiently dormant that it contributes to the insulating qualities of the aggregate 50.

Figure 10:
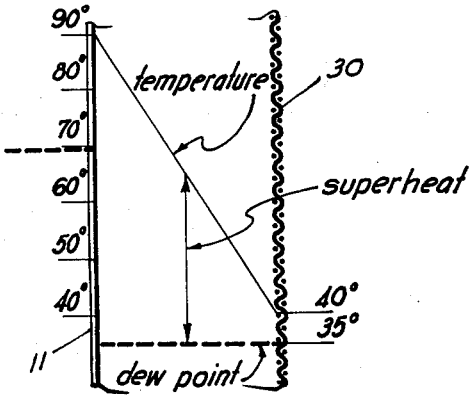
FIG. 10 is a schematic graph of temperature drop and dew point across the enclosure depicted in FIG. 5.

The function of the present invention can best be illustrated by reference to the diagram in FIG. 10, wherein a temperature gradient graph between the two walls 11 and 30, separated by the aggregate (but not shown) are depicted. In that illustration the inside air is characterized as having a temperature of 40° F and a dew point of 35° F and the outside air is depicted as having a temperature of 90° F and dew point of 70° F. Through the use of the insulating aggregate 50, between the walls 11 and 30, the interior air is progressively heated as it approaches the outer wall, as indicated by the line marked "temperature". This progressively superheats the moisture adjacent to the wall 11. Thus, the temperature of the wall 11 is maintained above the ambient air dew point of 70° F to prevent condensation of the moisture on the outside of wall 11. Also, there is no tendency of the moisture to accumulate on the inside or inner wall 30, due to the equilibrium conditions between the air within the aggregates and the air in the interior of the structure 10. There is, of course, some immigration of the moisture through the membrane like outer wall 11. This is, however, maintained at a minimum, due to the small temperature differential gradient across the wall 11.

If the interior of the structure is normally heated, rather than cooled, the structure 210 of FIG. 6 is recommended. If both heating and cooling of the interior is involved, the structure 310 of FIG. 7 is recommended. Furthermore, additional insulating properties can be imparted by providing a structure 410 as depicted in FIG. 8.

It is now seen that, through the provision of a porous, foraminous or permeable wall, such as walls 30, 130, 230, 330, or 330*a* and 430, adjacent the colder side of the structures of the present invention, for the side on which the temperature is to be reduced and the provision of insulation with an interconnected air space, quite large, well insulated, low cost structure can be provided.

The structures described above are quite versatile and can readily be used for enclosures for ski slopes or ice skating rinks or they may be used as cold storage warehouses, sub zero storage warehouses, coliseums, convention halls and for stadia.

The insulation can have almost any thickness for example from a minimum of about two inches to a maximum of two feet, or more.

We claim:

1. An air supported structure comprising:

a. a first flexible, imperforate wall shaped to form an envelope capable of being supported, in ambient air, by air at a pressure within said envelope greater than the pressure of the ambient air;

b. a second perforate, flexible wall disposed adjacent to but spaced from said first wall, said second wall being provided with pores or openings throughout substantially the entire area of said second wall so as to be pervious at all times to the free passage of air and moisture, therethrough; and c. means for connecting said first flexible wall and said second flexible wall for defining an insulating material receiving space therebetween;

d. there being provided for the aforesaid walls, an opening, larger than the pores or openings of said second wall, and through which a light-weight aggregate insulating material may be blown to fill the space between said walls.

2. The structure defined in claim 1 wherein said second wall is within the envelope defined by said first wall.

3. The structure defined in claim 1 wherein said second wall is nylon net.

4. The structure defined in claim 8 wherein said nylon net has about 20 threads per inch in both directions.

5. An air supported structure comprising:

a. a first flexible, imperforate wall shaped to form an envelope capable of being supported, in ambient air, by air at a pressure within said envelope greater than the pressure of the ambient air;

b. a second perforate, flexible wall disposed adjacent to but spaced from said first wall, said second wall being provided with pores or openings so as to be pervious to the passage of air and moisture, therethrough;

c. means for connecting said first flexible wall and said second flexible wall for defining an insulating material receiving space therebetween;

d. there being provided for the aforesaid walls, an opening, larger than the pores or openings of said second wall, and through which a light-weight insulating material may be blown to fill the space between said walls; and e. insulating material disposed in said space between said walls.

6. The structure defined in claim 5 including:

a. air conditioning means to cool and dry the air inside of said envelope; and b. blower means to maintain the pressure of air inside of said envelope higher than that of air outside of said envelope.

7. The structure defined in claim 6 wherein said insulating material are aggregates.

8. The structure defined in claim 7 wherein said aggregates have particle diameters of from about one-fourth inch to about one-half inch.

9. The structure defined in claim 6 wherein said aggregates are composed of expanded polystyrene.

10. The structure defined in claim 5 including a flexible tube disposed between said first wall and second wall, one end of said tube passing through said opening, and the other end of said tube terminating above said one end and between said walls.

11. The structure defined in claim 10 wherein said one end of said tube passes through said first wall and is adapted to receive insulating material blown into said one end for directing said insulating material through said tube and out of said other end and into the space between said first wall and said second wall.

12. The structure defined in claim 5 wherein said means for connecting said first wall and said second wall includes a plurality of transversely disposed longitudinally spaced ribs defining with said first wall and said second wall a plurality of juxtaposed compartments.

13. The structure defined in claim 5 wherein said insulating material includes a plurality of expanded polystyrene aggregates.

14. The structure defined in claim 5 including a third perforate flexible wall disposed on a side of said first wall opposite to said second wall, and insulating material includes a plurality of light weight aggregates between said first wall and said second wall and also between said first wall and said third wall.

15. The structure defined in claim 5 including a third flexible imperforate wall, said first wall and said third wall defining an air space therebetween, and insulating material including a plurality of light weight aggregates between said first wall and said second wall.

16. An air supported structure comprising:

a. a first flexible, imperforate wall shaped to form an envelope capable of being supported, in ambient air, by air at a pressure within said envelope greater than the pressure of the ambient air;

b. a second perforate, flexible nylon net wall disposed adjacent to but spaced from said first wall, said second wall being provided with pores or openings so as to be pervious to the passage of air and moisture, therethrough; and c. means for connecting said first flexible wall and said second flexible wall for defining an insulating material receiving space therebetween;

d. there being provided for the aforesaid walls, an opening, larger than the pores or openings of said second wall, and through which a light-weight insulating material may be blown to fill the space between said walls.

17. Process of producing an insulated air supported structure, comprising the steps of:

a. Creating an envelope having an impermeable, flexible first wall and a flexible second wall disposed adjacent to said first wall for defining an insulation receiving cavity therebetween;

b. Disposing said envelope on a ground site for the structure, c. inflating said envelope by applying air pressure on the inside of said envelope;

d. propelling insulating particles in a stream of fluid into the insulation receiving cavity after the envelope has been erected; and e. releasing the fluid from the insulation receiving cavity as the cavity is being filled.

18. The process defined in claim 17 wherein said insulating particles are expanded polystyrene aggregates.

19. The process defined in claim 18 wherein said cavity forms an arch and wherein said insulating material is discharged upwardly from one side of the cavity and passes through the topmost portion of the cavity to be received in the opposite side of the cavity.

20. The process defined in claim 18 wherein said second wall is pervious or permeable to said fluid.

21. The process defined in claim 18 wherein said insulating materials are aggregates, and wherein said aggregates are propelled by air pressure into said cavity.

22. The process defined in claim 21 wherein said cavity includes a plurality of juxtaposed compartments and wherein the compartments are successively filled.

23. The process defined in claim 21 wherein a nozzle is inserted into said cavity and said aggregates are propelled through a tube and through said nozzle into said cavity.

24. The process defined in claim 21 wherein a flexible upstanding tube is disposed in said cavity and wherein said aggregates are propelled through said tube in an upward direction into said cavity.

25. The process defined in claim 21 wherein said cavity includes a plurality of arcuate juxtaposed compartments arching upwardly from both sides of the envelope and wherein said aggregates are discharged from positions adjacent the top of the arch into each of said compartments.

26. The process defined in claim 21 wherein said aggregates are expanded polystyrene.

27. The process defined in claim 21 wherein said aggregates are cork particles.

* * * * *